US009410104B2

(12) United States Patent
Baker et al.

(10) Patent No.: US 9,410,104 B2
(45) **Date of Patent: *Aug. 9, 2016**

(54) STAR POLYMER LUBRICATING COMPOSITION

(71) Applicant: The Lubrizol Corporation, Wickliffe, OH (US)

(72) Inventors: Mark R. Baker, Midland, MI (US); Marina Baum, Chagrin Falls, OH (US); Barton J. Schober, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/786,947

(22) Filed: Mar. 6, 2013

(65) Prior Publication Data

US 2013/0184189 A1 Jul. 18, 2013

Related U.S. Application Data

(63) Continuation of application No. 12/298,166, filed on Mar. 30, 2009, which is a continuation of application No. PCT/US2007/066943, filed on Apr. 19, 2007.

(60) Provisional application No. 60/745,420, filed on Apr. 24, 2006.

(51) Int. Cl.

| | |
|---|---|
| ***C10M 143/00*** | (2006.01) |
| ***C10M 163/00*** | (2006.01) |
| ***C10M 141/10*** | (2006.01) |
| ***C07F 9/165*** | (2006.01) |
| ***C10M 135/36*** | (2006.01) |
| ***C10M 119/12*** | (2006.01) |
| ***C10M 161/00*** | (2006.01) |

(52) U.S. Cl.

CPC ..... *C10M 119/12* (2013.01); *C10M 161/00* (2013.01); *C10M 2209/084* (2013.01); *C10M 2215/28* (2013.01); *C10M 2219/022* (2013.01); *C10M 2223/043* (2013.01); *C10M 2227/061* (2013.01); *C10M 2227/062* (2013.01); *C10N 2220/029* (2013.01); *C10N 2240/04* (2013.01); *C10N 2240/042* (2013.01); *C10N 2240/044* (2013.01); *C10N 2260/14* (2013.01)

(58) Field of Classification Search

None

See application file for complete search history.

(56) References Cited

U.S. PATENT DOCUMENTS

| | | | | |
|---|---|---|---|---|
| 5,070,131 | A | 12/1991 | Rhodes et al. | |
| 5,354,484 | A * | 10/1994 | Schwind et al. | 508/192 |
| 5,955,405 | A | 9/1999 | Liesen et al. | |
| 6,586,375 | B1 | 7/2003 | Gahagan et al. | |
| 2002/0147118 | A1 * | 10/2002 | Visger et al. | 508/466 |
| 2005/0038146 | A1 | 2/2005 | Fish, Jr. et al. | |
| 2006/0189490 | A1 * | 8/2006 | Dardin et al. | 508/469 |
| 2007/0082827 | A1 * | 4/2007 | Schmidt et al. | 508/469 |
| 2009/0118150 | A1 * | 5/2009 | Baum et al. | 508/264 |

FOREIGN PATENT DOCUMENTS

| | | |
|---|---|---|
| WO | 2004087850 | 10/2004 |

OTHER PUBLICATIONS

Jenkins et al., "Glossary of Basic Terms in Polymer Science", International Union of Pure and Applied Chemistry, vol. 68, No. 12, pp. 2287-2311, 1996.

* cited by examiner

*Primary Examiner* — Vishal Vasisth

(74) *Attorney, Agent, or Firm* — Eryn Ace Fuhrer, Esq.; Teresan W. Gilbert, Esq.

(57) ABSTRACT

The invention provides a lubricating composition containing (a) a polymer derived from greater than 50 wt % or more of a non-diene monomer, wherein the polymer has a weight average molecular weight of about 2000 to about 200,000, and wherein the polymer has a shear stability index of about 0 to about 25; (b) a phosphorus-containing acid, salt, or ester; (c) an extreme pressure agent, other than a phosphorus-containing acid, salt, or ester; and (d) an oil of lubricating viscosity. The invention further provides a method for lubricating a mechanical device with the lubricating composition.

18 Claims, No Drawings

STAR POLYMER LUBRICATING COMPOSITION

This application is a CON of Ser. No. 12/298,166, filed Mar. 30, 2009, which is a CON of 371 application PCT/US07/66943, filed Apr. 19, 2007, claiming benefit of 60/745,420, filed Apr. 24, 2006.

FIELD OF INVENTION

The present invention relates to a lubricating composition containing a polymer such as a star polymer, a phosphorus-containing compound and an extreme pressure agent. The invention further provides a method for lubricating a mechanical device using the lubricating composition.

BACKGROUND OF THE INVENTION

The use of star polymers in lubricating compositions is known. The star polymers known in lubricating compositions are summarised in the prior art below.

International Application WO 04/087850 discloses lubricating compositions containing block copolymers prepared from RAFT (Reversible Addition Fragmentation Transfer) or ATRP (Atom Transfer Radical Polymerisation) polymerisation processes. The polymers have frictional properties. The block copolymer may have di-block, tri-block, multi-block, comb and/or star architecture. However, no guidance is given on methods suitable to prepare star copolymers. Also disclosed are polymers suitable for greases, motor oils, gearbox oils, turbine oils, hydraulic fluids, pump oils, heat transfer oils, insulation oils, cutting oils and cylinder oils.

U.S. patent application Ser. No. 05/038,146 discloses star polymers derived from (i) a core portion comprising a polyvalent (meth) acrylic monomer, oligomer or polymer thereof or a polyvalent divinyl non-acrylic monomer, oligomer or polymer thereof; and (ii) at least two arms of polymerized alkyl (meth)acrylate ester. The polymers may be prepared by RAFT, ATRP or nitroxide mediated techniques.

International Application WO 96/23012 discloses star-branched polymers prepared from acrylic or methacrylic monomers. The polymers have a core or nucleus derived from acrylate or methacrylate esters of polyols. Further the polymers have molecular weights and other physical characteristics that make them useful for lubricating oil compositions. The star-branched polymers disclosed are prepared by anionic polymerisation techniques.

The star polymers of EP 979 834 require from 5 to 10 weight percent of a C16 to C30 alkyl (meth)acrylate and from 5 to 15 weight percent of butyl methacrylate. A viscosity index improver with a C16 to C30 alkyl (meth)acrylate monomer present at 5 weight percent or more has reduced low temperature viscosity performance because the polymer has a waxy texture.

U.S. Pat. No. 5,070,131 disclose gear oil compositions having improved shear stability index essentially consisting of gear oil, a viscosity index improver comprising a hydrogenated star polymer comprising at least four arms, the arms comprising, before hydrogenation, polymerized conjugated diolefin monomer units and the arms having a number average molecular weight within the range of about 3,000 to about 15,000.

None of the prior art references above disclose fully formulated lubricating compositions that simultaneously achieve acceptable viscosity index (VI), oil blend thickening capabilities, improved fuel economy (Corporate Average Fuel Economy (CAFE)), shear stability, good low temperature viscosity performance, and low viscosity modifier treatment level whilst maintaining the appropriate lubricating performance for a mechanical device, such as a gear, or manual transmission.

In view of the prior art it would be advantageous to have a lubricating composition containing a polymer that is capable of providing acceptable viscosity index (VI), oil blend thickening capabilities, shear stability, good low temperature viscosity performance, and low viscosity modifier treatment level whilst maintaining the appropriate lubricating performance for a mechanical device. The present invention provides a lubricating composition capable of providing acceptable viscosity index (VI), oil blend thickening capabilities, shear stability, good low temperature viscosity performance, and low viscosity modifier treatment level whilst maintaining the appropriate lubricating performance for a mechanical device.

The prior art references, specifically WO 96/23012 and U.S. Pat. No. 5,070,131 employ anionic polymerisation techniques to prepare the polymer. Anionic polymerisation techniques are believed to involve complex processes that require systems to be substantially water-free, acid-free, oxygen-free, dry, clean, and have non-contaminated vessels. In one particular embodiment it would be advantageous to have a lubricating composition that does not require a polymer prepared with complex processes that require oxygen-free, dry, clean, non-contaminated vessels. In one embodiment the lubricating composition contains a polymer that does not require preparation by anionic polymerisation techniques.

SUMMARY OF THE INVENTION

In one embodiment the invention provides a lubricating composition comprising:

(a) a polymer derived from greater than 50 wt % or more of a non-diene monomer, wherein the polymer has a weight average molecular weight of about 2000 to about 200,000, and wherein the polymer has a shear stability index of about 0 to about 25;

(b) a phosphorus-containing acid, salt, or ester;

(c) an extreme pressure agent, other than a phosphorus-containing acid, salt, or ester; and (d) an oil of lubricating viscosity.

In one embodiment the invention provides a lubricating composition comprising:

(a) about 0.1 to about 50 wt % of a polymer derived from greater than 50 wt % or more of a non-diene monomer, wherein the polymer has a weight average molecular weight of about 2000 to about 200,000, and wherein the polymer has a shear stability index of about 0 to about 25;

(b) about 0.01 wt % to about 20 wt % of a phosphorus-containing acid, salt, or ester;

(c) about 0.01 wt % to about 20 wt % of an extreme pressure agent, other than a phosphorus-containing acid, salt, or ester; and (d) about 10 wt % to about 99.88 wt % of an oil of lubricating viscosity.

In one embodiment the invention provides a lubricating composition comprising:

(a) a polymer derived from greater than 50 wt % or more of a non-diene monomer, wherein the polymer has radial or star architecture;

(b) a phosphorus-containing acid, salt, or ester;

(c) an extreme pressure agent, other than a phosphorus-containing acid, salt, or ester; and (d) an oil of lubricating viscosity.

In one embodiment the invention provides a lubricating composition comprising:

(a) a polymer derived from greater than 50 wt % or more of a non-diene monomer, wherein the polymer has a weight average molecular weight of about 2000 to about 200,000, and wherein the polymer has radial or star architecture;

(b) a phosphorus-containing acid, salt, or ester;

(c) an extreme pressure agent, other than a phosphorus-containing acid, salt, or ester; and (d) an oil of lubricating viscosity.

In one embodiment the invention provides a method for lubricating a mechanical device comprising supplying to the mechanical device a lubricating composition, wherein the mechanical device comprises at least one of an internal combustion engine, a hydraulic system, a gear, a gearbox, automatic transmission or a manual transmission, and wherein the lubricating composition comprises:

(a) a polymer derived from greater than 50 wt % or more of a non-diene monomer, wherein the polymer has a weight average molecular weight of about 2000 to about 200,000, and wherein the polymer has a shear stability index of about 0 to about 25;

(b) a phosphorus-containing acid, salt, or ester;

(c) an extreme pressure agent, other than a phosphorus-containing acid, salt, or ester; and (d) an oil of lubricating viscosity.

In one embodiment the invention provides a method for lubricating a mechanical device comprising a supplying to the mechanical device a lubricating composition, wherein the mechanical device comprises at least one of an internal combustion engine, a hydraulic system, a gear, a gearbox automatic transmission or a manual transmission, and wherein the lubricating composition comprises:

(a) a polymer derived from greater than 50 wt % or more of a non-diene monomer, wherein the polymer has radial or star architecture;

(b) a phosphorus-containing acid, salt, or ester;

(c) an extreme pressure agent, other than a phosphorus-containing acid, salt, or ester; and (d) an oil of lubricating viscosity.

In one embodiment the invention provides a method for lubricating a mechanical device comprising a supplying to the mechanical device a lubricating composition, wherein the mechanical device comprises at least one of an internal combustion engine, a hydraulic system, a gear, a gearbox automatic transmission or a manual transmission, and wherein the lubricating composition comprises:

(a) a polymer derived from greater than 50 wt % or more of a non-diene monomer, wherein the polymer has a weight average molecular weight of about 2000 to about 200,000, and wherein the polymer has radial or star architecture;

(b) a phosphorus-containing acid, salt, or ester;

(c) an extreme pressure agent, other than a phosphorus-containing acid, salt, or ester; and (d) an oil of lubricating viscosity.

In one embodiment the invention provides a method for lubricating a mechanical device comprising a supplying to the mechanical device a lubricating composition, wherein the mechanical device is a gear, a gearbox or a manual transmission, and wherein the lubricating composition comprises:

(a) a polymer derived from greater than 50 wt % or more of a non-diene monomer, wherein the polymer has a weight average molecular weight of about 2000 to about 200,000, and wherein the polymer has a shear stability index of about 0 to about 25;

(b) a phosphorus-containing acid, salt, or ester;

(c) an extreme pressure agent, other than a phosphorus-containing acid, salt, or ester; and (d) an oil of lubricating viscosity.

In one embodiment the invention provides a method for lubricating a mechanical device comprising a supplying to the mechanical device a lubricating composition, wherein the mechanical device is a gear, a gearbox or a manual transmission, and wherein the lubricating composition comprises:

(a) a polymer derived from greater than 50 wt % or more of a non-diene monomer, wherein the polymer has radial or star architecture;

(b) a phosphorus-containing acid, salt, or ester;

(c) an extreme pressure agent, other than a phosphorus-containing acid, salt, or ester; and (d) an oil of lubricating viscosity.

In one embodiment the invention provides a method for lubricating a mechanical device comprising a supplying to the mechanical device a lubricating composition, wherein the mechanical device is a gear, a gearbox or a manual transmission, and wherein the lubricating composition comprises:

(a) a polymer derived from greater than 50 wt % or more of a non-diene monomer, wherein the polymer has a weight average molecular weight of about 2000 to about 200,000, and wherein the polymer has radial or star architecture;

(b) a phosphorus-containing acid, salt, or ester;

(c) an extreme pressure agent, other than a phosphorus-containing acid, salt, or ester; and (d) an oil of lubricating viscosity.

DETAILED DESCRIPTION OF THE INVENTION

The present invention provides a lubricating composition and a method for lubricating a mechanical device as disclosed above.

Polymer

As used herein terms such as "the polymer has (or contains) monomers composed of" means the polymer comprises units derived from the particular monomer referred to.

In different embodiments the polymer may contain greater than 50 wt %, or about 55 wt % or more, or about 70 wt % or more, or about 90 wt % or more, or about 95 wt % or more, or about 100 wt % of a non-diene monomer (that is to say, non-diene monomer units or units derived from polymerisation of one of more non-diene monomers). Examples of diene monomers include 1,3-butadiene or isoprene. Examples of a non-diene or mono-vinyl monomer include styrene, methacrylates, or acrylates.

When the polymer is a radial or star polymer, the amount of non-diene monomer as described above refers only to the composition of the polymeric arms, i.e., the wt % values as given are exclusive of any di-functional (or higher) monomer found in a polymer core.

As described hereinafter the molecular weight of the viscosity modifier has been determined using known methods, such as GPC analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312. As used herein the weight average and number weight average molecular weights of the polymers of the invention are obtained by integrating the area under the peak corresponding to the polymer of the invention, which is normally the major high molecular weight peak, excluding peaks associated with diluents, impurities, uncoupled polymer chains and other additives. Typically, the polymer of the invention has radial or star architecture.

The weight average molecular weight of the polymer may be in the range of about 8,000 to about 150,000, or about 10,000 to about 100,000 or about 15,000 to about 75,000, or about 25,000 to about 70,000.

As used herein the shear stability index (SSI) may be determined by a 20 hour KRL test (Volkswagon Tapered Bearing Roller Test). The test procedure is set out in both CEC-L-45-A-99 and DIN 51350-6-KRL/C.

The polymer SSI may be in the range of about 0 to about 20, or about 0 to about 15, or about 0 to about 10, or about 0 to about 5. An example of a suitable range for the SSI includes about 1 to about 5.

The polymer may be a homopolymer or a copolymer. In one embodiment the polymer is a copolymer. The polymer may have a branched, a comb-like, a radial or a star architecture. In one embodiment the polymer may be a radial or star polymer, or mixtures thereof. The polymer may be a polymer having a random, tapered, di-block, tri-block or multi-block architecture. Typically the polymer has random or tapered architecture.

When the polymer has branched, comb-like, radial or star architecture, the polymer has polymeric arms. For such materials, the polymeric arms may have block-arm architecture, or hetero-arm architecture, or tapered-arm architecture. Tapered-arm architecture has a variable composition across the length of a polymer arm. For example, the tapered arm may be composed of, at one end, a relatively pure first monomer and, at the other end, a relatively pure second monomer. The middle of the arm is more of a gradient composition of the two monomers.

The polymer derived from a block-arm typically contains one or more polymer arms derived from two or more monomers in block structure within the same arm. A more detailed description of the block-arm is given in Chapter 13 (pp. 333-368) of "Anionic Polymerization, Principles and Practical Applications" by Henry Hsieh and Roderic Quirk (Marcel Dekker, Inc, New York, 1996) (hereinafter referred to as Hsieh et al.).

The hetero-arm, or "mikto-arm," polymeric arm architecture typically contains arms which may vary from one another either in molecular weight, composition, or both, as defined in Hsieh et al., cited above. For example, a portion of the arms of a given polymer may be of one polymeric type and a portion of a second polymeric type. More complex hetero-arm polymers may be formed by combining portions of three or more polymeric arms with a coupling agent.

When the polymer has radial or star architecture the polymeric arms may be chemically bonded to a core portion. The core portion may be a polyvalent (meth) acrylic monomer, oligomer, polymer, or copolymer thereof, or a polyvalent divinyl non-acrylic monomer, oligomer polymer, or copolymer thereof. In one embodiment the polyvalent divinyl non-acrylic monomer is divinyl benzene. In one embodiment the polyvalent (meth)acrylic monomer is an acrylate or methacrylate ester of a polyol or a methacrylamide of a polyamine, such as an amide of a polyamine, for instance a methacrylamide or an acrylamide. In different embodiments the polyvalent (meth)acrylic monomer is (i) a condensation reaction product of an acrylic or methacrylic acid with a polyol or (ii) a condensation reaction product of an acrylic or methacrylic acid with a polyamine.

The polyol which may be condensed with the acrylic or methacrylic acid in one embodiment contains 2 to 20 carbon atoms, in another embodiment 3 to 15 carbon atoms and in another embodiment 4 to 12 carbon atoms; and the number of hydroxyl groups present in one embodiment is 2 to 10, in another embodiment 2 to 4 and in another embodiment 2. Examples of polyols include ethylene glycol, poly (ethylene glycols), alkane diols such as 1,6 hexanene diol or triols such as trimethylolpropane, oligomerised trimethylolpropanes such as Boltorn® materials sold by Perstorp Polyols. Examples of polyamines include polyalkylenepolyamines such as ethylenediamine, diethylenetriamine, triethylenetetramine, tetraethylene pentamine, pentaethylenehexamine and mixtures thereof.

Examples of the polyvalent unsaturated (meth)acrylic monomer include ethylene glycol diacrylate, ethylene glycol dimethacrylate, diethylene glycol diacrylate, diethylene glycol dimethacrylate, glycerol diacrylate, glycerol triacrylate, mannitol hexaacrylate, 4-cyclohexanediol diacrylate, 1,4-benzenediol dimethacrylate, pentaerythritol tetraacrylate, 1,3-propanediol diacrylate, 1,5-pentanediol dimethacrylate, bis-acrylates and methacrylates of polyethylene glycols of molecular weight 200-4000, polycaprolactonediol diacrylate, pentaerythritol triacrylate, 1,1,1-trimethylolpropane triacrylate, pentaerythritol diacrylate, pentaerythritol triacrylate, pentaerythritol tetraacrylate, triethylene glycol diacrylate, triethylene glycol dimethacrylate, 1,1,1-trimethylolpropane trimethacrylate, hexamethylenediol diacrylate or hexamethylenediol dimethacrylate or an alkylene bis-(meth) acrylamide.

The amount of polyvalent coupling agent may be an amount suitable to provide coupling of polymer previously prepared as arms onto a core comprising the coupling agent in monomeric, oligomeric, or polymeric form, to provide a star polymer. As described above, suitable amounts may be determined readily by the person skilled in the art with minimal experimentation, even though several variables may be involved. For example, if an excessive amount of coupling agent is employed, or if excessive unreacted monomer from the formation of the polymeric arms remains in the system, crosslinking rather than star formation may occur. Typically the mole ratio of polymer arms to coupling agent may be about 50:1 to about 1.5:1 (or 1:1), or about 30:1 to about 2:1, or about 10:1 to about 3:1, or about 7:1 to about 4:1, or about 4:1 to about 1:1. In other embodiments the mole ratio of polymer arms to coupling agent may be about 50:1 to about 0.5:1, or about 30:1 to about 1:1, or about 7:1 to about 2:1. The desired ratio may also be adjusted to take into account the length of the arms, longer arms sometimes tolerating or requiring more coupling agent than shorter arms. Typically the material prepared is soluble in an oil of lubricating viscosity.

In one embodiment the polymeric arms of the polymer have a polydispersity of about 2 or less, or about 1.7 or less, or about 1.5 or less, for instance, about 1 to about 1.4 as measured before radial or star polymer formation or on uncoupled units. In one embodiment the overall polymer composition, which includes the polymer with radial or star architecture, has polydispersity with a bimodal or higher modal distribution. The bimodal or higher distribution in the overall composition is believed to be partially due to the presence of varying amounts of uncoupled polymer chains and/or uncoupled radial or star-polymers or star-to-star coupling formed as the polymer is prepared.

The overall composition containing polymers with the radial or star architecture may thus also have uncoupled polymeric arms present (also referred to as a polymer chain or linear polymer). The percentage conversion of a polymer chain to radial or star polymer may be at least about 10%, or at least about 20%, or at least about 40%, or at least about 55%, for instance at least about 70%, at least about 75% or at least about 80%. In one embodiment the conversion of polymer chain to radial or star polymer may be about 90%, about 95% or about 100%. In one embodiment a portion of the polymer chains does not form a star polymer and remains as a linear polymer. In one embodiment the polymer is a mixture of (i) a polymer with radial or star architecture, and (ii) linear polymer chains (also referred to as uncoupled polymeric arms). In different embodiments the amount of radial or star architecture within the polymer composition may be about 10 wt % to about 85 wt %, or about 25 wt % to about 70 wt % of the amount of polymer. In different embodiments the linear polymer chains may be present at about 15 wt % to about 90 wt %, or about 30 wt % to about 75 wt % of the amount of polymer.

The polymer with branched, comb-like, radial or star architecture may have about 2 or more arms, or about 5 or more arms, or about 7 or more arms, or about 10 or more arms, for instance about 12 to about 100, or about 14 to about 50, or about 16 to about 40 arms. The polymer with branched, comb-like, radial or star architecture may have about 120 arms or less, or about 80 arms or less, or about 60 arms or less.

The polymer may be obtained/obtainable from a controlled radical polymerisation technique. Examples of a controlled radical polymerisation technique include RAFT, ATRP or nitroxide mediated processes. The polymer may also be obtained/obtainable from anionic polymerisation processes. In one embodiment the polymer may be obtained/obtainable from RAFT, ATRP or anionic polymerisation processes. In one embodiment the polymer may be obtained/obtainable from RAFT or ATRP polymerisation processes. In one embodiment the polymer may be obtained/obtainable from a RAFT polymerisation process.

Methods of preparing polymers using ATRP, RAFT or nitroxide-mediated techniques are disclosed in the example section of U.S. patent application Ser. No. 05/038,146, examples 1 to 47.

More detailed descriptions of polymerisation mechanisms and related chemistry is discussed for nitroxide-mediated polymerisation (Chapter 10, pages 463 to 522), ATRP (Chapter 11, pages 523 to 628) and RAFT (Chapter 12, pages 629 to 690) in the *Handbook of Radical Polymerization*, edited by Krzysztof Matyjaszewski and Thomas P. Davis, 2002, published by John Wiley and Sons Inc (hereinafter referred to as "Matyjaszewski et al.").

The discussion of the polymer mechanism of ATRP polymerisation is shown on page 524 in reaction scheme 11.1, page 566 reaction scheme 11.4, reaction scheme 11.7 on page 571, reaction scheme 11.8 on page 572 and reaction scheme 11.9 on page 575 of Matyjaszewski et al.

In ATRP polymerisation, groups that may be transferred by a radical mechanism include halogens (from a halogen-containing compound) or various ligands. A more detailed review of groups that may be transferred is described in U.S. Pat. No. 6,391,996, or paragraphs 61 to 65 of U.S. patent application Ser. No. 05/038,146.

Examples of a halogen-containing compound that may be used in ATRP polymerisation include benzyl halides such as p-chloromethylstyrene, α-dichloroxylene, α,α-dichloroxylene, α,α-dibromoxylene, hexakis(α-bromomethyl)benzene, benzyl chloride, benzyl bromide, 1-bromo-1-phenylethane and 1-chloro-1-phenylethane; carboxylic acid derivatives which are halogenated at the α-position, such as propyl 2-bromopropionate, methyl 2-chloropropionate, ethyl 2-chloropropionate, methyl 2-bromopropionate, and ethyl 2-bromoisobutyrate; tosyl halides such as p-toluenesulfonyl chloride; alkyl halides such as tetrachloromethane, tribromomethane, 1-vinylethyl chloride, and 1-vinylethyl bromide; and halogen derivatives of phosphoric acid esters, such as dimethylphosphoric acid.

In one embodiment when the halogen compound is employed, a transition metal such as copper is also present. The transition metal may be in the form of a salt. The transition metal is capable of forming a metal-to-ligand bond and the ratio of ligand to metal depends on the dentate number of the ligand and the co-ordination number of the metal. The ligand may be a nitrogen or phosphorus-containing ligand.

Examples of a suitable ligand include triphenylphosphine, 2,2-bipyridine, alkyl-2,2-bipyridine, such as 4,4-di-(5-heptyl)-2,2-bipyridine, tris(2-aminoethyl)amine (TREN), N,N,N',N',N"-pentamethyldiethylenetriamine, 4,4-di-(5-nonyl)-2,2-bipyridine, 1,1,4,7,10,10-hexamethyltriethylenetetramine and/or tetramethylethylenediamine. Further suitable ligands are described in, for example, International Patent application WO 97/47661. The ligands may be used individually or as a mixture. In one embodiment the nitrogen containing ligand is employed in the presence of copper. In one embodiment the ligand is phosphorus-containing with triphenyl phosphine ($PPh_3$) a common ligand. A suitable transition metal for a triphenyl phosphine ligand includes Rh, Ru, Fe, Re, Ni or Pd.

In RAFT polymerisation, chain transfer agents are important. A more detailed review of suitable chain transfer agents is found in paragraphs 66 to 71 of U.S. patent application Ser. No. 05/038,146. Examples of a suitable RAFT chain transfer agent include benzyl 1-(2-pyrrolidinone)carbodithioate, benzyl (1,2-benzenedicarboximido) carbodithioate, 2-cyanoprop-2-yl 1-pyrrolecarbodithioate, 2-cyanobut-2-yl 1-pyrrolecarbodithioate, benzyl 1-imidazolecarbodithioate, N,N-dimethyl-S-(2-cyanoprop-2-yl)dithiocarbamate, N,N-diethyl-S-benzyl dithiocarbamate, cyanomethyl 1-(2-pyrrolidone) carbodithoate, cumyl dithiobenzoate, 2-dodecylsulphanylthiocarbonylsulphanyl-2-methyl-propionic acid butyl ester, O-phenyl-5-benzyl xanthate, N,N-diethyl S-(2-ethoxy-carbonylprop-2-yl)dithiocarbamate, dithiobenzoic acid, 4-chlorodithiobenzoic acid, O-ethyl-S-(1-phenylethyl)xanthtate, O-ethyl-S-(2-(ethoxycarbonyl) prop-2-yl)xanthate, O-ethyl-S-(2-cyanoprop-2-yl)xanthate, O-ethyl-S-(2-cyanoprop-2-yl)xanthate, O-ethyl-S-cyanomethyl xanthate, O-pentafluorophenyl-5-benzyl xanthate, 3-benzylthio-5,5-dimethylcyclohex-2-ene-1-thione or benzyl 3,3-di(benzylthio)prop-2-enedithioate, S,S'-bis-(α,α'-disubstituted-α"-acetic acid)-trithiocarbonate, S,S'-bis-(α,α'-disubstituted-α"-acetic acid)-trithiocarbonate or S-alkyl-S'-((α,α'-disubstituted-α"-acetic acid)-trithiocarbonates, benzyl dithiobenzoate, 1-phenylethyl dithiobenzoate, 2-phenylprop-2-yl dithiobenzoate, 1-acetoxyethyl dithiobenzoate, hexakis(thiobenzoylthiomethyl)benzene, 4-bis(thiobenzoylthiomethyl)benzene, 1,2,4,5-tetrakis(thiobenzoylthiomethyl)benzene, 1,4-bis-(2-(thiobenzoylthio)-prop-2-yl)benzene, 1-(4-methoxyphenyl)ethyl dithiobenzoate, benzyl dithioacetate, ethoxycarbonylmethyl dithioacetate, 2-(ethoxycarbonyl)prop-2-yl dithiobenzoate, 2,4,4-trimethylpent-2-yl dithiobenzoate, 2-(4-chlorophenyl)prop-2-yl dithiob enzoate, 3-vinylbenzyl dithiobenzoate, 4-vinylbenzyl dithiobenzoate, S-benzyl diethoxyphosphinyldithioformate, tert-butyl trithioperbenzoate, 2-phenylprop-2-yl 4-chlorodithiobenzoate, 2-phenylprop-2-yl 1-dithionaphthalate, 4-cyanopentanoic acid dithiobenzoate, dibenzyl tetrathioterephthalate, dibenzyl trithiocarbonate, carboxymethyl dithiobenzoate or poly(ethylene oxide) with dithiobenzoate end group or mixtures thereof.

In one embodiment a suitable RAFT chain transfer agent includes 2-Dodecylsulfanylthiocarbonylsulfanyl-2-methylpropionic acid butyl ester, cumyl dithiobenzoate or mixtures thereof.

A discussion of the polymer mechanism of RAFT polymerisation is shown on page 664 to 665 in section 12.4.4 of Matyjaszewski et al.

When the polymer is prepared from anionic polymerisation techniques, initiators include, for example, hydrocarbyllithium initiators such as alkyllithium compounds (e.g., methyl lithium, n-butyl lithium, sec-butyl lithium), cycloalkyllithium compounds (e.g., cyclohexyl lithium and aryl lithium compounds (e.g., phenyl lithium, 1-methylstyryl lithium, p-tolyl lithium, naphyl lithium and 1,1-diphenyl-3-methylpentyl lithium. Also, useful initiators include naphthalene sodium, 1,4-disodio-1,1,4,4-tetraphenylbutane, diphenylmethylpotassium or diphenylmethylsodium.

The polymerisation process may also be carried out in the absence of moisture and oxygen and in the presence of at least one inert solvent. In one embodiment anionic polymerisation is conducted in the absence of any impurity which is detrimental to an anionic catalyst system. The inert solvent includes a hydrocarbon, an aromatic solvent or ether. Suitable solvents include isobutane, pentane, cyclohexane, benzene, toluene, xylene, tetrahydrofuran, diglyme, tetraglyme, orthoterphenyl, biphenyl, decalin or tetralin.

The anionic polymerisation process may be carried out at a temperature of about 0° C. to about −78° C.

A more detailed description of process to prepare the polymer derived from anionic processes is discussed in International Patent Application WO 96/23012, page 3, line 11 to page 5, line 8. Page 7, line 25 to page 10, line 15 of WO 96/23012 further describes methods of preparing polymers by anionic polymerisation techniques. A detailed description of anionic polymerisation process is given in *Textbook of Polymer Science*, edited by Fred W. Billmeyer Jr., Third Edition, 1984, Chapter 4, pages 88-90.

The polymer may comprise at least one of (a) a polymer derived from monomers comprising: (i) a vinyl aromatic monomer; and (ii) a carboxylic monomer (typically maleic anhydride, maleic acid, (meth)acrylic acid, itaconic anhydride or itaconic acid) or derivatives thereof; (b) a poly(meth) acrylate; (c) a functionalised polyolefin; (d) an ethylene vinyl acetate copolymer; (e) a fumarate copolymer; (f) a copolymer derived from (i) an α-olefin and (ii) a carboxylic monomer (typically maleic anhydride, maleic acid, (meth)acrylic acid, itaconic anhydride or itaconic acid) or derivatives thereof; or (g) mixtures thereof. In one embodiment the polymer with pendant groups comprises a polymethacrylate or mixtures thereof.

When the polymer is a polymethacrylate, the polymer may be derived from a monomer composition comprising:

(a) about 50 wt % to about 100 wt % (or about 65 wt % to about 95 wt %) of an alkyl methacrylate, wherein the alkyl group of the methacrylate has about 10 to about 30, or about 10 to about 20, or about 12 to about 18, or about 12 to about 15 carbon atoms;

(b) about 0 wt % to about 40 wt % (or about 5 wt % to about 30 wt %) of an alkyl methacrylate, wherein the alkyl group of the methacrylate has about 1 to about 9, or about 1 to about 4 carbon atoms (for example methyl, butyl, or 2-ethylhexyl); and (c) about 0 wt % to about 10 wt % (or about 0 wt % to about 5 wt %) of a nitrogen-containing monomer.

As used herein the term (meth)acrylate means acrylate or methacrylate units. The alkyl (meth)acrylate includes for example compounds derived from saturated alcohols, such as methyl methacrylate, butyl methacrylate, 2-methylpentyl, 2-propylheptyl, 2-butyloctyl, 2-ethylhexyl (meth)acrylate, octyl (meth)acrylate, nonyl (meth)acrylate, isooctyl (meth) acrylate, isononyl (meth)acrylate, 2-tert-butylheptyl (meth) acrylate, 3-isopropylheptyl (meth)acrylate, decyl (meth) acrylate, undecyl (meth)acrylate, 5-methylundecyl (meth) acrylate, dodecyl (meth)acrylate, 2-methyldodecyl (meth) acrylate, tridecyl (meth)acrylate, 5-methyltridecyl (meth) acrylate, tetradecyl (meth)acrylate, pentadecyl (meth) acrylate, hexadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl-(meth)acrylate, octadecyl (meth)acrylate, nonadecyl (meth) acrylate, eicosyl (meth)acrylate, cetyleicosyl (meth)acrylate, stearyleicosyl (meth)acrylate, docosyl (meth)acrylate and/or eicosyltetratriacontyl (meth)acrylate; (meth)acrylates derived from unsaturated alcohols, such as oleyl (meth)acrylate; and cycloalkyl (meth)acrylates, such as 3-vinyl-2-butylcyclohexyl (meth)acrylate or bornyl (meth)acrylate.

The alkyl (meth)acrylates with long-chain alcohol-derived groups may be obtained, for example, by reaction of a (meth) acrylic acid (by direct esterification) or methyl methacrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Liar) 125 of Condea Augusta, Milan; Dehydad® and Lorol® of Henkel KGaA (now Cognis) as well as Linopol® 7-11 and Acropol® 91 of Ugine Kuhlmann.

In one embodiment the star polymer is further functionalised in the core or the polymeric arms with a nitrogen-containing monomer. The nitrogen-containing monomer may include a vinyl-substituted nitrogen heterocyclic monomer, a dialkylaminoalkyl (meth)acrylate monomer, a dialkylaminoalkyl (meth)acrylamide monomer, a tertiary-(meth)acrylamide monomer or mixtures thereof.

In one embodiment the core or polymeric arms further comprise a (meth)acrylamide or a nitrogen containing (meth) acrylate monomer that may be represented by the formula:

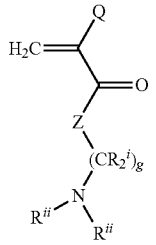

wherein

Q is hydrogen or methyl and, in one embodiment, Q is methyl;

Z is an N—H group or O (oxygen);

each $R^{ii}$ is independently hydrogen or a hydrocarbyl group containing about 1 to about 8, or about 1 to about 4 carbon atoms;

each $R^{i}$ is independently hydrogen or a hydrocarbyl group containing 1 to 2 carbon atoms and, in one embodiment, each $R^{i}$ is hydrogen; and g is an integer from about 1 to about 6 and, in one embodiment, g is about 1 to about 3.

Examples of a suitable nitrogen-containing monomer include N,N-dimethylacrylamide, N-vinyl carbonamides such as N-vinyl-formamide, vinyl pyridine, N-vinylacetoamide, N-vinyl-n-propionamides, N-vinyl-i-propionamides, N-vinyl hydroxyacetoamide, N-vinyl imidazole, N-vinyl pyrrolidinone, N-vinyl caprolactam, dimethylaminoethyl acrylate (DMAEA), dimethylaminoethylmethacrylate (DMAEMA), dimethylaminobutylacrylamide, dimethylamine-propylmethacrylate (DMAPMA), dimethylamine-propyl-acrylamide, dimethylaminopropylmethacrylamide, dimethylaminoethyl-acrylamide or mixtures thereof.

The polymer may be present in the lubricating composition at ranges including about 0.1 to about 50 wt %, or about 1 to about 25 wt %, or about 2 to about 10 wt %.

Phosphorus-Containing Acid, Salt or Ester

The phosphorus-containing acid, salt or ester may be an antiwear agent and/or an extreme pressure agent. In one embodiment the phosphorus-containing acid, salt or ester is in the form of a mixture.

The phosphorus-containing acid, salt or ester may be ash-containing (i.e. metal containing) or ashless (i.e. metal free (prior to being mixed with other components)).

The phosphorus-containing acid, salt or ester includes (i) a non-ionic phosphorus compound; (ii) an amine salt of a phosphorus compound; (iii) an ammonium salt of a phosphorus compound; (iv) a monovalent metal salt of a phosphorus compound, such as a metal dialkyldithiophosphate or a metal dialkylphosphate; or (v) mixtures of (i), (ii), (iii) or (iv).

In one embodiment the phosphorus-containing acid, salt or ester comprises a metal dialkyldithiophosphate. The alkyl groups of the dialkyldithiophosphate may be linear or branched containing about 2 to about 20 carbon atoms, provided that the total number of carbons is sufficient to make the metal dialkyldithiophosphate oil soluble. The metal of the metal dialkyldithiophosphate typically includes monovalent or divalent metals. Examples of suitable metals include sodium, potassium, copper, calcium, magnesium, barium or zinc. In one embodiment the phosphorus-containing acid, salt or ester is a zinc dialkyldithiophosphate. Examples of a suitable zinc dialkylphosphate often referred to as ZDDP, ZDP or ZDTP) include zinc di-(2-methylpropyl) dithiophosphate, zinc di-(amyl) dithiophosphate, zinc di-(1,3-dimethylbutyl) dithiophosphate, zinc di-(heptyl) dithiophosphate, zinc di-(octyl) dithiophosphate di-(2-ethylhexyl) dithiophosphate, zinc di-(nonyl) dithiophosphate, zinc di-(decyl) dithiophosphate, zinc di-(dodecyl) dithiophosphate, zinc di-(dodecylphenyl) dithiophosphate, zinc di-(heptylphenyl) dithiophosphate, or mixtures thereof.

In one embodiment the phosphorus-containing acid, salt or ester is other than metal dialkyldithiophosphate.

In one embodiment the phosphorus-containing acid, salt or ester comprises an ammonium or amine salt of a phosphorus-containing acid or ester.

The amine salt of a phosphorus acid or ester includes phosphoric acid esters and amine salts thereof dialkyldithiophosphoric acid esters and amine salts thereof; amine salts of phosphites; and amine salts of phosphorus-containing carboxylic esters, ethers, and amides; and mixtures thereof.

The amine salt of a phosphorus acid or ester may be used alone or in combination. In one embodiment the amine salt of a phosphorus compound is derived from an amine salt of a phosphorus compound, or mixtures thereof.

In one embodiment the amine salt of a phosphorus acid or ester includes a partial amine salt-partial metal salt compounds or mixtures thereof. In one embodiment the amine salt of a phosphorus acid or ester further comprises a sulphur atom in the molecule.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain about 2 to about 30 carbon atoms, or in other embodiments about 8 to about 26, or about 10 to about 20, or about 13 to about 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing about 2 to about 30, or about 6 to about 26, or about 8 to about 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the amine salt of a phosphorus acid or ester includes an amine with C11 to C14 tertiary alkyl primary groups or mixtures thereof. In one embodiment the amine salt of a phosphorus compound includes an amine with C14 to C18 tertiary alkyl primary amines or mixtures thereof. In one embodiment the amine salt of a phosphorus compound includes an amine with C18 to C22 tertiary alkyl primary amines or mixtures thereof.

Mixtures of amines may also be used in the invention. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment the amine salt of a phosphorus acid or ester is the reaction product of a C14 to C18 alkylated phosphoric acid with Primene 81R™ (produced and sold by Rohm & Haas) which is a mixture of C11 to C14 tertiary alkyl primary amines.

Examples of the amine salt of a phosphorus acid or ester include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment a dithiophosphoric acid may be reacted with an epoxide or a glycol. This reaction product is further reacted with a phosphorus acid, anhydride, or lower ester (where "lower" signifies about 1 to about 8, or about 1 to about 6, or about 1 to about 4, or 1 to about 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols may be aliphatic glycols having 1 to about 12, or about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at about 58° C. over a period of about 45 minutes to about 514 grams of hydroxypropyl O,O-di(4-methyl-2-pentyl)phosphorodithioate (prepared by reacting di(4-methyl-2-pentyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulphur, and an acid number of 87 (bromophenol blue).

In one embodiment the phosphorus-containing acid, salt or ester comprises a non-ionic phosphorus compound. Typically the non-ionic phosphorus compound may have an oxidation of +3 or +5. The different embodiments comprise phosphite ester, phosphate esters, or mixtures thereof. A more detailed description of the non-ionic phosphorus compound include column 9, line 48 to column 11, line 8 of U.S. Pat. No. 6,103,673.

The phosphorus-containing acid, salt or ester may be present in the lubricating composition at about 0.01 wt % to about 20 wt %, or about 0.05 wt % to about 10 wt %, or about 0.1 wt % to about 5 wt % of the lubricating composition.

Extreme Pressure Agent

The extreme pressure agent, is other than a phosphorus-containing acid, salt, or ester (i.e. component (b) of the invention).

The extreme pressure agent may include a boron-containing compound, a sulphur-containing compound, or mixtures thereof.

In one embodiment the extreme pressure agent comprises a boron-containing compound or mixtures thereof.

In one embodiment the extreme pressure agent comprises a sulphur-containing compound or mixtures thereof.

In one embodiment the extreme pressure agent comprises a sulphur-containing compound and a boron-containing compound.

The extreme pressure agent may be present in the lubricating composition at about 0.01 wt % to about 20 wt %, or about 0.05 wt % to about 10 wt %, or about 0.1 wt % to about 8 wt % of the lubricating composition.

Sulphur-Containing Compound

In one embodiment the extreme pressure agent is a sulphur-containing compound. In one embodiment the sulphur-containing compound is a sulphurised olefin, a polysulphide, or mixtures thereof.

Examples of the sulphurised olefin include an olefin derived from propylene, isobutylene, pentene, an organic sulphide and/or polysulphide including benzyldisulphide; bis-(chlorobenzyl) disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof. In one embodiment the sulphurised olefin includes an olefin derived from propylene, isobutylene, pentene or mixtures thereof.

In one embodiment the extreme pressure agent sulphur-containing compound comprising a dimercaptothiadiazole, or mixtures thereof. Examples of the dimercaptothiadiazole include 2,5-dimercapto-1,3-4-thiadiazole or a hydrocarbyl-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units. Suitable 2,5-dimercapto-1,3-4-thiadiazole compounds include 2,5-bis(tert-nonyldithio)-1,3,4-thiadiazole or 2-tert-nonyldithio-5-mercapto-1,3,4-thiadiazole.

The number of carbon atoms on the hydrocarbyl substituents of the hydrocarbyl-substituted 2,5-dimercapto-1,3-4-thiadiazole typically include about 1 to about 30, or about 2 to about 20, or about 3 to about 16.

Borate Ester or Borate Alcohol

In one embodiment the extreme pressure agent comprises a boron-containing compound. The boron-containing compound includes a borate ester, a borate alcohol, a borated dispersant or mixtures thereof.

In one embodiment the boron-containing compound is a borate ester or a borate alcohol. The borate ester or borate alcohol compounds are substantially the same except the borate alcohol has at least one hydroxyl group that is not esterified. Therefore, as used herein the term "borate ester" is used to refer to either borate ester or borate alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms i.e. vicinal. Hereinafter "epoxy compounds" is used when referring to "at least one compound selected from epoxy compounds, halohydrin compounds, epihalohydrin compounds and mixtures thereof."

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment the borate ester is formed by the reaction of a boron compound with an epoxy compound, dihydric alcohols, trihydric alcohols or higher alcohols. The borate ester may be represented by at least one of formulae (I) to (VI):

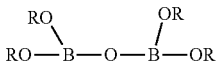

(I)

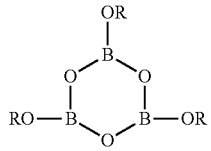

(II)

-continued (III)

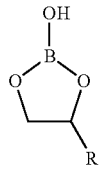

(IV)

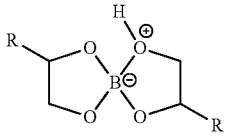

(V)

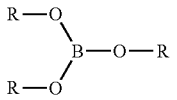

(VI)

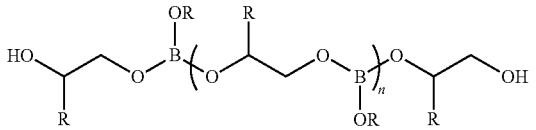

wherein each R may be hydrogen or hydrocarbyl groups provided that the borate ester is oil soluble.

In one embodiment at least two of the R groups per the above formulae are hydrocarbyl groups. The hydrocarbyl groups may be alkyl, aryl or cycloalkyl when any two adjacent R groups are connected in a ring. When R is alkyl, the group may be saturated or unsaturated. In one embodiment the hydrocarbyl group is an unsaturated alkyl. In one embodiment the hydrocarbyl group is cyclic. In one embodiment the hydrocarbyl groups are mixtures of alkyl and cycloalkyl.

Generally there is no upper limit on the number of carbon atoms in the molecule, but a practical limits may include about 500, or about 400, or about 200, or about 100, or about 60. For example the number of carbon atoms present in each R may be about 1 to about 60, or about 1 to about 40, or about 1 to about 30 carbon atoms, provided the total number of carbon atoms on the R groups typically ranges from in about 9 or more, or about 10 or more, or about 12 or more, or about 14 or more.

In one embodiment all R groups are hydrocarbyl groups containing about 1 to about 30 carbon atoms, provided the total number of carbon atoms is about 9 or more.

In one embodiment the boron-containing compound is represented by formula (I) described above. In this embodiment, the borate ester represented by formula (I) contains three hydrocarbyl R groups each containing in different embodiments about 1 to about 8, or about 2 to about 7, or about 3 to about 6 carbon atoms, provided the total number of carbon atoms on the R groups may be at least about 4 or more, or about 6 or more, or about 8 or more.

Examples of R groups include isopropyl, n-butyl, isobutyl, amyl, 2-pentenyl, 4-methyl-2-pentyl, 2-ethylhexyl, heptyl, isooctyl, nonyl, decyl, undecyl, dodecenyl, dodecyl, tridecyl, tetradecyl, pentadecyl, hexadecyl, heptadecyl, octadecyl, nonadecyl and eicosyl groups.

The epoxy compounds useful for preparing the borate ester of the invention may be represented by the formulae (VIIa) or (VIIb):

(VIIa)

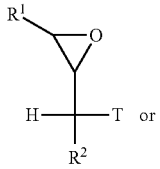

(VIIb)

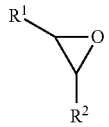

wherein $R^1$ is independently H or an alkyl chain containing 1 to about 4, or about 1 to about 2 carbon atoms;

$R^2$ is an alkyl chain containing about 8 to about 30, or about 10 to about 26, or about 12 to about 22 carbon atoms; and T is independently hydrogen or a halogen.

In one embodiment T is a halogen, such as, chlorine, bromine, iodine or fluorine or mixtures thereof; and the epoxy compounds are epihalohydrin compounds. In one embodiment T is chlorine. In one embodiment T is hydrogen.

In one embodiment the epoxy compounds of the invention include commercial mixtures of $C_{14}$-$C_{16}$ epoxides or $C_{14}$-$C_{18}$ epoxides. In one embodiment, the epoxy compounds of the invention have been purified. Examples of suitable purified epoxy compounds may include 1,2-epoxydecane, 1,2-epoxyundecane, 1,2-epoxydodecane, 1,2-epoxytridecane, 1,2-epoxybutadecane, 1,2-epoxypentadecane 1,2-epoxyhexadecane, 1,2-epoxyheptadecane, 1,2-epoxyoctadecane, 1,2-epoxynonadecane and 1,2-epoxyicosane. In one embodiment purified epoxy compounds include 1,2-epoxytetradecane, 1,2-epoxypentadecane 1,2-epoxyhexadecane, 1,2-epoxyheptadecane, 1,2-epoxyoctadecane. In one embodiment purified epoxy compounds include 1,2-epoxyhexadecane.

The dihydric alcohols, trihydric alcohols or higher alcohols may contain about 2 to about 30, or about 4 to about 26, or about 6 to about 20 carbon atoms. The alcohol compounds may include glycerol compounds, such as, glycerol monooleate.

The borate ester may be prepared by blending the boron compound and the epoxy compounds or alcohols described above and heating them at a suitable temperature, such as at about 80° C. to about 250° C., about 90° C. to about 240° C., or about 100° C. to about 230° C., until the desired reaction has occurred. The molar ratio of the boron compounds to the epoxy compounds is typically about 4:1 to about 1:4, or about 1:1 to about 1:3, or about 1:2. An inert liquid may be used in performing the reaction. The liquid may be, for instance, toluene, xylene, chlorobenzene, dimethylformamide and mixtures thereof. Water is typically formed and is distilled off during the reaction. Alkaline reagents may be used to catalyze the reaction.

In one embodiment suitable borate ester compounds include tripropyl borate, tributyl borate, tripentyl borate, trihexyl borate, triheptyl borate, trioctyl borate, trinonyl borate and tridecyl borate.

In one embodiment the borate ester compounds include tributyl borate, tri-2-ethylhexyl borate or mixtures thereof.

Borated Dispersant

In another embodiment, the boron-containing compound is a borated dispersant, typically derived from an N-substituted long chain alkenyl succinimide. In one embodiment the borated dispersant comprises a polyisobutylene succinimide.

In one embodiment the borated dispersant is used in combination with a sulphur-containing compound or a borated ester.

In one embodiment the extreme pressure agent is other than a borated dispersant.

The number average molecular weight of the long chain alkenyl group includes ranges of about 350 to about 5000, or about 500 to about 3000, or about 550 to 1500. The long chain alkyenyl group may have a number average molecular weight of about 550, or about 750, or about 950-1000.

The N-substituted long chain alkenyl succinimides are borated using a variety of agents including boric acid (for example, metaboric acid, $HBO_2$, orthoboric acid, $H_3BO_3$, and tetraboric acid, $H_2B_4O_7$), boric oxide, boron trioxide, and alkyl borates described in formulae (I) to (VI) above. In one embodiment the borating agent is boric acid which may be used alone or in combination with other borating agents.

The borated dispersant may be prepared by blending the boron compound and the N-substituted long chain alkenyl succinimides and heating them at a suitable temperature, such as, about 80° C. to about 250° C., or about 90° C. to about 230° C., or about 100° C. to about 210° C., until the desired reaction has occurred. The molar ratio of the boron compounds to the N-substituted long chain alkenyl succinimides may have ranges including about 10:1 to about 1:4, or about 4:1 to about 1:3, or about 1:2. An inert liquid may be used in performing the reaction. The liquid may include toluene, xylene, chlorobenzene, dimethylformamide or mixtures thereof.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include polyol esters (such as Prolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content≤0.03 wt %, and ≥90 wt % saturates, viscosity index 80-120); Group III (sulphur content≤0.03 wt %, and ≥90 wt % saturates, viscosity index≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

The amount of the oil of lubricating viscosity present is typically the balance remaining after subtracting from 100 wt % the sum of the amount of the polymer, the phosphorus-containing acid, salt, or ester, the extreme pressure agent and other performance additives.

The lubricating composition may be in the form of a concentrate and/or a fully formulated lubricant. If the polymer, the phosphorus-containing phosphorus-containing acid, salt, or ester; and the extreme pressure agent, other than component (b) are in the form of a concentrate (which may be combined with additional oil to form, in whole or in part, a finished lubricant), the ratio of the of components (a), (b) and (c) (i.e. the polymer, the phosphorus-containing phosphorus-containing acid, salt, or ester; and the extreme pressure agent, other than component (b)) to the oil of lubricating viscosity and/or to diluent oil include the ranges of about 1:99 to about 99:1 by weight, or about 80:20 to about 10:90 by weight.

Other Performance Additive

The composition of the invention optionally further includes at least one other performance additive. The other performance additives include metal deactivators, detergents, dispersants, viscosity index improvers (that is, viscosity modifiers other than the star polymer of the invention), antioxidants, corrosion inhibitors, foam inhibitors, demulsifiers, pour point depressants, seal swelling agents and mixtures thereof.

The total combined amount of the other performance additive compounds present on an oil free basis may include ranges of 0 wt % to 25 wt %, or 0.01 wt % to 20 wt %, or 0.1 wt % to 15 wt % or 0.5 wt % to 10 wt %, or 1 to 5 wt % of the composition. Although one or more of the other performance additives may be present, it is common for the other performance additives to be present in different amounts relative to each other.

Antioxidants include molybdenum compounds such as molybdenum dithiocarbamates, sulphurised olefins, hindered phenols, aminic compounds (such as alkylated diphenylamines (typically di-nonyl diphenylamine, octyl diphenylamine, di-octyl diphenylamine)); detergents include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a mono- and/or a dithiophosphoric acid, a saligenin, an alkylsalicylate, and a salixarate; and dispersants include N-substituted long chain alkenyl succinimides, as well as Mannich condensation products as well as post-treated versions thereof. Post-treated dispersants include those by reaction with urea, thiourea, dimercaptothiadiazoles, carbon disulphide, aldehydes, ketones, carboxylic acids, hydrocarbon-substituted succinic anhydrides, nitriles, epoxides, boron compounds, and phosphorus compounds.

Antiscuffing agents including organic sulphides and polysulphides, such as benzyldisulphide, bis-(chlorobenzyl) disulphide, dibutyl tetrasulphide, di-tertiary butyl polysulphide, di-tert-butylsulphide, sulphurised Diels-Alder adducts or alkyl sulphenyl N'N-dialkyl dithiocarbamates; and extreme pressure (EP) agents including chlorinated wax, metal thiocarbamates, such as zinc dioctyldithiocarbamate and barium heptylphenol diacid may also be used in the composition of the invention.

Additionally the invention may also include friction modifiers other than component (b)(i.e. the phosphorus-containing acid, salt, or ester) including fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylenepolyamines.

Viscosity modifiers other than the polymer (a) of the invention, including hydrogenated copolymers of styrene-butadiene, ethylene-propylene copolymers, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers. Conventional poly (meth)acrylate polymers may be derived from monomers substantially the same as those defined for the polymeric arms. However, the conventional poly(meth)acrylate is generally free of a functional group selected from a halogen, an —O—N═ group and an —S—C(═S)— group. In one embodiment the polymer of the invention is mixed with a conventional viscosity modifier.

Other performance additives such as corrosion inhibitors including octylamine octanoate, condensation products of dodecenyl succinic acid or anhydride and a fatty acid such as oleic acid with a polyamine; metal deactivators including derivatives of benzotriazoles (typically tolyltriazole), 1,2,4-triazoles, benzimidazoles, 2-alkyldithiobenzimidazoles or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and seal swell agents including Exxon Necton-37™ (FN 1380) and Exxon Mineral Seal Oil (FN 3200); and dispersant viscosity modifiers (often referred to as DVM) include functionalised polyolefins, for example, ethylene-propylene copolymers that have been functionalized with the reaction product of maleic anhydride and an amine, a polymethacrylate functionalised with an amine, or styrene-maleic anhydride copolymers reacted with an amine; may also be used in the composition of the invention.

INDUSTRIAL APPLICATION

The method of the invention is useful for lubricating a variety of mechanical devices. The mechanical device comprises at least one of an internal combustion engine (for crankcase lubrication), a hydraulic system, a gear, a gearbox or a transmission.

The transmission may include manual transmissions, continuously variable transmissions (CVT), infinitely variable transmissions (IVT), Torridol transmissions, continuously slipping torque converted clutches (CSTCC), automatic transmissions, stepped automatic transmissions, traction drive transmissions or dual clutch transmissions (DVT). In one embodiment the transmission is a manual transmission.

The lubricating composition suitable for the mechanical device such as a gear, a gearbox or a manual transmission, may have a Brookfield viscosity at −40° C. (as determined by ASTM D2983 using a rheometer with Low Viscosity (LV) capabilities) with ranges including about 15 to about 150,000 mPa·s, or about 15 to about 100,000 mPa·s, or about 15 to about 50,000 mPa·s.

The following examples provide illustrations of the invention. These examples are non exhaustive and are not intended to limit the scope of the invention.

EXAMPLES

Preparative Example 1 (Prep 1) is prepared in a vessel equipped with a nitrogen inlet flowing at about 28.3 L/hr, medium speed mechanical stirrer, a thermocouple and a water-cooled condenser is charged with about 70 g of $C_{12-15}$ alkyl methacrylate, about 30 g of 2-ethylhexyl methacrylate, about 1.08 g of Trigonox™-21 (initiator), about 8.33 g of bis-dodecyltrithiocarbonate (chain transfer agent) and about 48.59 g of oil. The contents of the vessel are stirred under a nitrogen blanket for about 20 minutes to ensure sufficient mixing. The nitrogen flow is reduced to about 14.2 L/hr and the mixture is set to be heated to about 90° C. for about 3 hours. About 3.96 g of ethylene glycol dimethacrylate is added to the vessel and the mixture is stirred at about 90° C. for an additional about 3 hours. The resultant polymer is then cooled to ambient temperature. The polymer is characterised as having a weight average molecular weight of about 34,100 g/mol and having a number average molecular weight of about 29,800 g/mol. The polymer is believed to have at least 4 polymeric arms (containing about 70 wt % of $C_{12-15}$ alkylmethacrylate, about 30 wt % of 2-ethylhexyl methacrylate) and the conversion to a star polymer is 64%, with 36% uncoupled linear polymer chains.

Comparative Example 1 (CE1) is a linear polymethacrylate prepared in a equipped with a nitrogen inlet flowing at about 28.3 L/hr, medium speed mechanical stirrer, a thermocouple and a water-cooled condenser is charged with about 496.6 g of $C_{12-15}$ alkylmethacrylate, about 218.4 g of 2-ethylhexyl methacrylate, about 77.5 g of oil, about 36.4 g of Trigonox™ 21 initiator and 36.4 g of n-dodecyl mercaptan. The contents of the vessel are shaken and mixed to ensure sufficient mixing. Then about one-third of the vessel contents are transferred into another vessel containing equipped with a mechanical overhead stirrer, water-cooled condenser, thermocouple, addition funnel and nitrogen inlet. The vessel further contains about 13.1 g of dimethylaminopropyl methacrylamide. The contents of the vessel are stirred for about 30 minutes under a nitrogen blanket (flow rate of about 28.3 L/hr. The vessel is then heated to about 110° C. with a nitrogen flow rate of about 14.2 L/hr. After the reaction temperature reaches an exotherm peak, the remaining two-thirds of the ⅔ of monomer mixture (from the first vessel) is added through the addition funnel over a period of about 90 minutes, before cooling the vessel to about 110° C. until the end of reaction. The vessel is charged with about 0.49 g of Trigonox™ 21 in about 4.41 g of oil. The contents of the vessel are stirred for about one hour before cooling to ambient temperature. The resultant polymer is characterised as having a weight average molecular weight of 8,400 g/mol and number average molecular weight of 2,600 g/mol.

Gear oil lubricating compositions are prepared according to the compositions in the following table. The polymer treat rates of EX1 and CE2 are determined to provide a lubricating composition with a viscosity of about 19 $mm^2/s$.

| | Lubricating Compositions (wt %) | |
|---|---|---|
| Additive | EX1 | CE2 |
| Prep 1 Polymer | 40 | — |
| CE1 Polymer | — | 48.4 |
| Amine salt of Phosphorus acid ester | 1.8 | 1.8 |
| Extreme Pressure Agent* | 6.2 | 6.2 |
| Other Performance Additives+ | 2.2 | 2.2 |
| Base Oil | 49.8 | 41.4 |

*where the extreme pressure agent includes at least one of a borated dispersant or a sulphurised olefin and +includes about 0.2 wt % of a polyacrylate pour point depressant.

The lubricating compositions are evaluated by determining the kinematic and Brookfield viscosities (by employing ASTM methods D445 at 100° C. and D2983 at −40° C. respectively). The viscosity index (VI) is also determined by employing ASTM method D2270. The results obtained are as follows:

| Test | EX1 | CE2 |
|---|---|---|
| Shear Stability Index | 5 | 6 |
| Kinematic Viscosity at 100°C. | 22.9 | 20.5 |
| Brookfield Viscosity at −40°C. | 152,000 | 1,000,000 |
| Viscosity Index | 179 | 162 |

The data obtained indicates that whilst both the lubricating composition of the invention and the comparative example have approximately equal shear stability index, the lubricating composition of the invention has a significantly lower Brookfield viscosity and an increased viscosity index. As a consequence, the lubricating composition of the invention is capable of providing acceptable viscosity index (VI), oil blend thickening capabilities, shear stability, good low temperature viscosity performance, and low viscosity modifier treatment level whilst maintaining the appropriate lubricating performance for a gear or gearbox.

While the invention has been explained in relation to its various embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(a) about 0.1 wt % to about 25 wt % of a polymer derived from greater than 50 wt % of more of a non-diene monomer, wherein the polymer has radial or star architecture;

(b) about 0.1 wt % to about 5 wt % of a phosphorus-containing acid, salt, or ester, wherein the phosphorus-containing acid, salt, or ester comprises an amine salt of a phosphorus acid or ester;

(c) about 0.1 wt % to about 8 wt % of an extreme pressure agent, wherein the extreme pressure agent, other than a phosphorus-containing acid, salt, or ester comprises a boron-containing compound, wherein the boron compound comprises a borate ester, a borate alcohol, a borated dispersant or mixtures thereof; and (d) an oil of lubricating viscosity, wherein the polymer is obtained from a RAFT or ATRP polymerisation process, wherein the polymer is a polymethacrylate having 7 or more arms, and wherein, the polymethacrylate is derived from a monomer composition comprising (a) about 50 wt % to about 95 wt % of an alkyl methacrylate comprising a mixture of alkyl methacrylates having 12 to 15 carbon atoms;

(b) about 5 wt % to about 40 wt % of an alkyl methacrylate, wherein the alkyl group of the methacrylate has about 1 to about 9 carbon atoms; and (c) about 0 wt % to about 10 wt % of a nitrogen containing monomer, wherein the polymethacrylate has a polymeric arm architecture that is random.

2. The lubricating composition of claim 1, wherein the polymer is derived from greater than 55 wt % of a non-diene monomer.

3. The lubricating composition of claim 1, wherein the polymer has a weight average molecular weight of about 15,000 to about 75,000.

4. The lubricating composition of claim 1, wherein the polymer has a shear stability index of about 0 to about 20.

5. The lubricating composition of claim 1, wherein the polymer is a copolymer.

6. The lubricating composition of claim 1, wherein the lubricating composition further comprises a component of linear polymer chains.

7. The lubricating composition of claim 1, wherein the alkyl group of the alkyl methacrylate of (a) has about 12 to about 15 carbon atoms.

8. A method for lubricating a mechanical device comprising a supplying to the mechanical device a lubricating composition, wherein the mechanical device is a gear, a gearbox or a manual transmission, and wherein the lubricating composition comprises:

(a) about 0.1 wt % to about 25 wt % of a polymer derived from greater than 50 wt % or more of a non-diene monomer, wherein the polymer has radial or star architecture;

(b) about 0.1 wt % to about 5 wt % of a phosphorus-containing acid, salt, or ester, wherein the phosphorus-containing acid, salt, or ester comprises an amine salt of a phosphorus acid or ester;

(c) about 0.1 wt % to about 8 wt % of an extreme pressure agent, wherein the extreme pressure agent, comprises a boron-containing compound, wherein the boron compound comprises a borate ester, a borate alcohol, a borated dispersant or mixtures thereof; and (d) an oil of lubricating viscosity, wherein the polymer is obtained from a RAFT or ATRP polymerization process, wherein the polymer is a polymethacrylate having 7 or more arms, and wherein the polymethacrylate is derived from a monomer composition comprising (a) about 50 wt % to about 95 wt % of an alkyl methacrylate comprising a mixture of alkyl methacrylates having 12 to 15 carbon atoms;

(b) about 5 wt % to about 40 wt % of an alkyl methacrylate, wherein the alkyl group of the methacrylate has about 1 to about 9 carbon atoms; and (c) about 0 wt % to about 10 wt % of a nitrogen containing monomer, wherein the polymethacrylate has a polymeric arm architecture that is random.

9. The method of claim 8, wherein the polymer has a weight average molecular weight of about 15,000 to about 75,000.

10. The method of claim 8, wherein the polymer has a shear stability index of about 0 to about 20.

11. The method of claim 8, wherein the polymer is a copolymer.

12. The method of claim 8, wherein the lubricating composition further comprises a component of linear polymer chains.

13. The method of claim 8, wherein the amine salt is formed from an amine having at least one hydrocarbyl group.

14. The method of claim 8, wherein the amine salt is formed from an amine having two hydrocarbyl groups.

15. The method of claim 8, wherein the amine salt is formed from an amine having three hydrocarbyl groups.

16. The method of claim 8, wherein the amine salt is formed from an amine having a hydrocarbyl group having about 10 to about 20 carbon atoms.

17. The method of claim 8, wherein the amine salt is formed from an amine having a hydrocarbyl group having about 13 to about 19 carbon atoms.

18. The method of claim 8, wherein the polymer is present at about 2 to about 10 wt % of the lubricating composition, and wherein the polymethacrylate is derived from a monomer composition consisting essentially of:

(a) about 65 wt % to about 96 wt % of an alkyl methacrylate comprising a mixture of alkyl methacrylates having 12 to 15 carbon atoms;

(b) about 5 wt % to about 30 wt % of an alkyl methacrylate, wherein the alkyl group of the methacrylate has about 1 to about 4 carbon atoms.

* * * * *